US010155240B2

(12) United States Patent
Sheridan

(10) Patent No.: US 10,155,240 B2
(45) **Date of Patent: *Dec. 18, 2018**

(54) FREESTANDING LANDSCAPE WATERFALL ASSEMBLY

(71) Applicant: Richard Sheridan, Neptune, NJ (US)

(72) Inventor: Richard Sheridan, Neptune, NJ (US)

( * ) Notice: Subject to any disclaimer, the term of this patent is extended or adjusted under 35 U.S.C. 154(b) by 244 days.

This patent is subject to a terminal disclaimer.

(21) Appl. No.: 14/695,878

(22) Filed: Apr. 24, 2015

(65) Prior Publication Data

US 2015/0224528 A1 Aug. 13, 2015

Related U.S. Application Data

(63) Continuation of application No. 13/690,991, filed on Nov. 30, 2012, now Pat. No. 9,016,594.

(51) Int. Cl.
*B05B 17/08* (2006.01)
*E04F 10/08* (2006.01)

(52) U.S. Cl.
CPC ..... *B05B 17/085* (2013.01); *E04F 10/08* (2013.01)

(58) Field of Classification Search
CPC ..... B05B 17/085
USPC ..... 239/17–23
See application file for complete search history.

(56) References Cited

U.S. PATENT DOCUMENTS 5,226,935 A 7/1993 Wolff et al.
5,915,132 A * 6/1999 Counts, Jr. ..... G03B 15/10 396/1
6,261,186 B1 * 7/2001 Henry ..... A63G 1/12 239/16
D470,215 S 2/2003 Lussier
D491,250 S 6/2004 Raymond et al.
6,913,204 B1 7/2005 Bradford
D598,973 S 8/2009 Muhlethaler
D643,505 S 8/2011 Haijin
D671,190 S 11/2012 Sheridan
D689,588 S 9/2013 Sheridan
D689,589 S 9/2013 Sheridan
(Continued)

OTHER PUBLICATIONS

Coastal Screen and Rail photo.*
Coastal Screen and Rail.*

*Primary Examiner* — Davis Hwu
(74) *Attorney, Agent, or Firm* — Patterson + Sheridan, LLP

(57) ABSTRACT

Embodiments of the invention relate to a freestanding landscape waterfall assembly which reduces the weight of the waterfall as compared to conventional cast block waterfalls. In one embodiment, a freestanding landscape waterfall includes a face plate having an elongated aperture, a manifold having an outlet configured to direct water through the aperture, and an engagement feature configured to suspend the face plate such that the elongated aperture is in a horizontal orientation. In another embodiment, a freestanding landscape waterfall assembly includes a freestanding landscape waterfall, an overhead support system configured to suspend the freestanding landscape waterfall, and a catch basin positionable below the freestanding landscape waterfall. In yet another embodiment, a freestanding landscape waterfall assembly kit includes a catch basin, a freestanding landscape waterfall configured to be suspended over the catch basin, and a pump system configured to pump water between the catch basin and the freestanding landscape waterfall.

16 Claims, 4 Drawing Sheets

(56) References Cited

U.S. PATENT DOCUMENTS

| | | | | |
|---|---|---|---|---|
| 9,016,594 | B2 * | 4/2015 | Sheridan | B05B 17/085 239/23 |
| 2013/0206859 | A1 | 8/2013 | Sheridan | |

* cited by examiner

FREESTANDING LANDSCAPE WATERFALL ASSEMBLY

CROSS-REFERENCE TO RELATED APPLICATION

This application is a continuation of U.S. application Ser. No. 13/690,991 filed on Nov. 30, 2012, which is hereby incorporated by reference in its entirety.

BACKGROUND OF THE INVENTION

Field of the Invention

Embodiments of the invention generally relate to a freestanding landscape waterfall, and more specifically, a modular freestanding landscape waterfall.

Description of the Related Art

Traditional landscape waterfalls are fabricated from interlocking precast concrete blocks. The heavy nature of the concrete blocks prohibits prefabrication and requires a prepared foundation and significant assembly expertise in order to put together the waterfall. This results in a significantly high expense in both materials and labor required to fabricate the waterfall, along with extensive site preparation required to support the heavy weight of the precast blocks. Furthermore, traditional landscape waterfalls are connected to a basin for catching the waterfall and this limits the variability in the height of the waterfall. Thus, there is a need for an improved landscape waterfall.

SUMMARY OF THE INVENTION

Embodiments of the present invention generally relate to a freestanding landscape waterfall assembly. The freestanding landscape waterfall may be prefabricated in modular components, thereby facilitating economical shipping and rapid assembly by homeowners having little or no masonry skills.

In one embodiment, a freestanding landscape waterfall includes a face plate having an elongated aperture, a manifold having an outlet configured to direct water through the aperture, and an engagement feature configured to suspend the face plate such that the elongated aperture is in a horizontal orientation.

In another embodiment, a freestanding landscape waterfall assembly includes a freestanding landscape waterfall, an overhead support system configured to suspend the freestanding landscape waterfall, and a catch basin positionable below the freestanding landscape waterfall.

In yet another embodiment, a freestanding landscape waterfall assembly kit includes a catch basin, a freestanding landscape waterfall configured to be suspended over the catch basin, and a pump system configured to pump water between the catch basin and the freestanding landscape waterfall.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
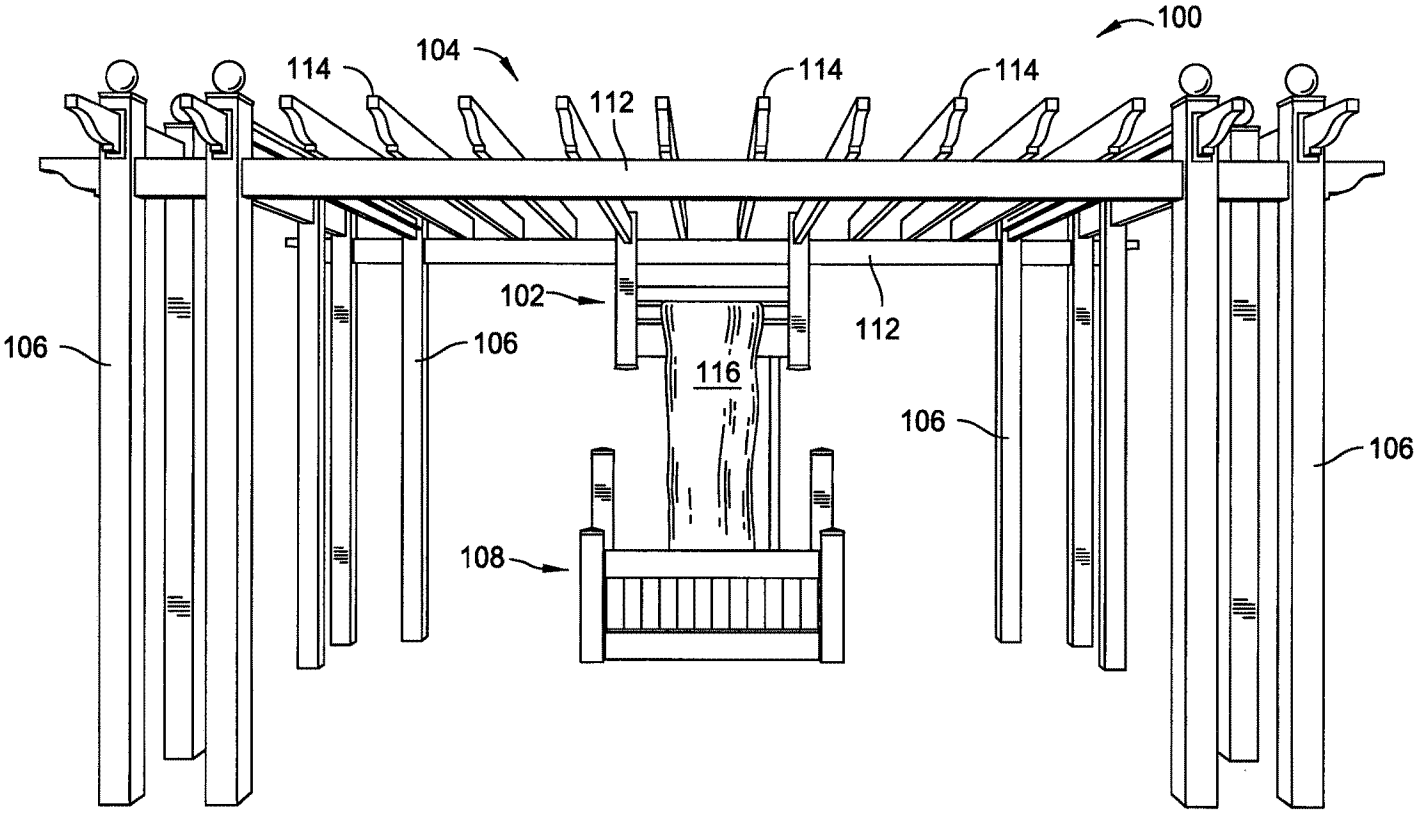
FIG. 1 is a perspective view of a freestanding landscape waterfall assembly suspended from a pergola.

FIG. 1 is a perspective view of one embodiment of a freestanding landscape waterfall assembly 100 of the present invention suspended from an overhead support system 104, such as a pergola. It is contemplated that the freestanding landscape waterfall assembly 100 may be suspended from other structures. The freestanding landscape waterfall assembly 100 may by fabricated primarily from plastic components, thereby resulting in a significantly lighter structure as compared to the stone and block structures.

In one embodiment of the freestanding landscape waterfall assembly 100 includes a freestanding landscape waterfall 102 and a catch basin 108. The freestanding landscape waterfall 102 is configured to be suspended from the overhead support system 104 above the catch basin 108 to allow water 116 exiting the landscape waterfall 102 to fall downward into the catch basin 108 thus creating a waterfall effect without having support structures disposed directly below or directly adjacent the catch basin 108.

Figure 2:
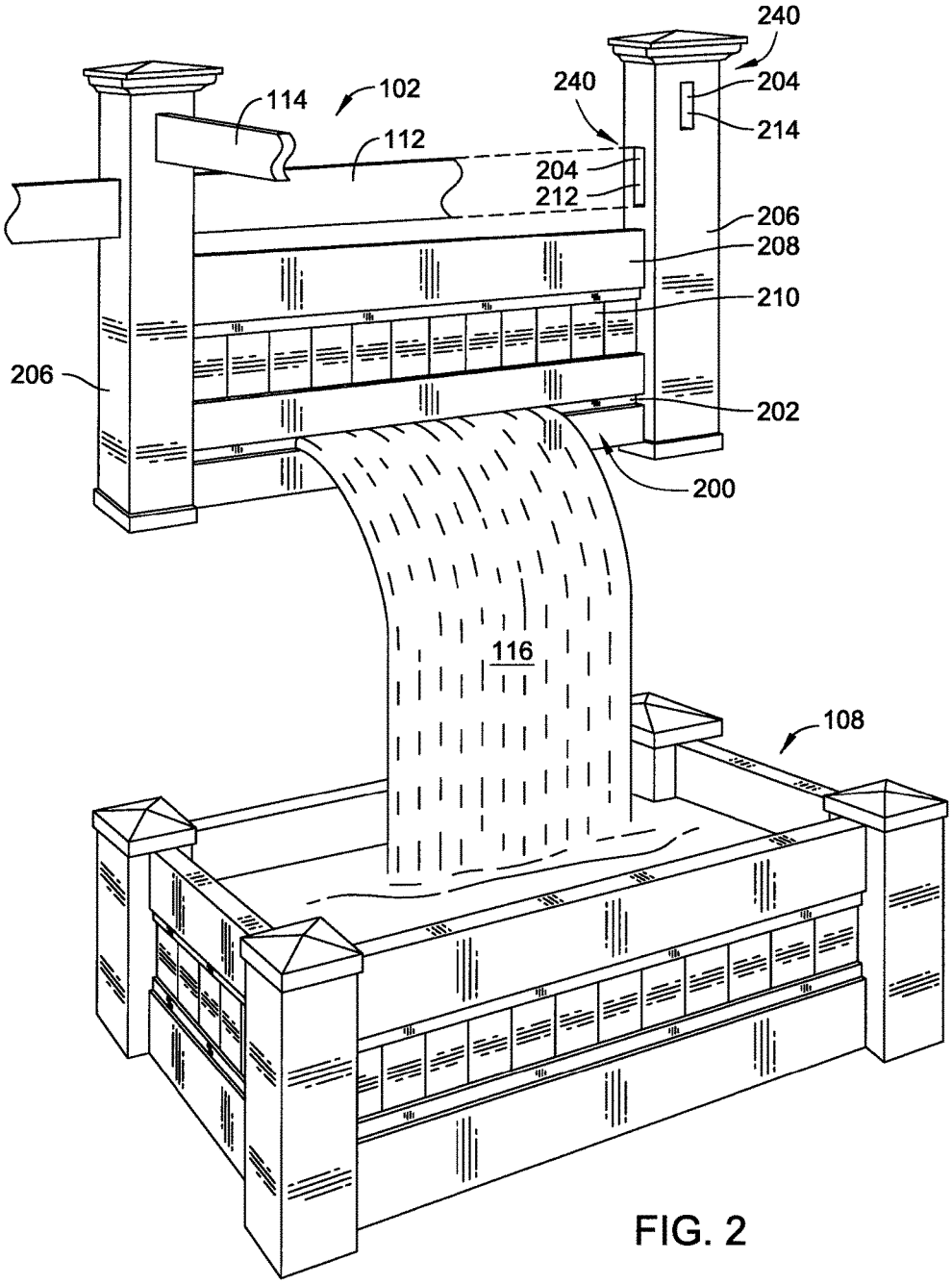
FIG. 2 is a perspective view of a freestanding landscape waterfall of FIG. 1.

Referring to FIG. 2, the free standing landscape waterfall 102 includes a face plate 200. The face plate 200 is a substantially vertical member having an aperture 202 formed therein through which water 116 is configured to flow into the catch basin 108. In one embodiment, the aperture 202 is an elongated horizontal slot. In one embodiment, the face plate 200 is fabricated from a plurality of extruded plastic forms. Suitable materials include PVC or other plastics extrudable and suitable for outdoor use. In one embodiment, the face plate 200 includes two substantially vertical posts 206 having a plurality of horizontal members 208 extending therebetween, and a face plate panel 210 disposed between the horizontal members 208. The substantially vertical posts 206 also include at least one engagement feature 240 which interface another structure to suspend the face plate 200 in the air above the ground or floor level.

The engagement feature 240 may be a hook, hole, dovetail, slot, strap or other structure suitable for supporting the weight of the face plate 200 above the catch basin 108. In one embodiment, the engagement feature 240 includes a first attachment receiving slot 212 configured to engage the overhead support system 204 and a second attachment receiving slot 214 configured to engage the overhead support system 204. The first attachment receiving slot 212 is oriented substantially parallel to the horizontal members 208 and aperture 202, and the second attachment receiving slot 214 has an orientation substantially perpendicular to the first attachment receiving slot 212.

The horizontal members 208 may be fastened to the vertical posts 206 in any suitable manner, for example, the vertical post 206 may have an aperture formed therein which accepts a mounting bracket (not shown). The mounting bracket may be completely external to the vertical post 206 or extend into the vertical post 206 through an aperture formed in the vertical post 206. The horizontal member 208 is inserted into the mounting bracket and is secured thereto utilizing adhesive, mechanical or other suitable fastener. In one embodiment, the vertical posts 206 and horizontal members 208 are extruded hollow plastic profiles. The face plate panel 210 is disposed between the horizontal members 208 making a substantially unitary structure. The face plate panel 210 may be fabricated from plastic, wood, metal, fiberglass or other suitable material. In one embodiment, the face plate panel 210 is fabricated from a plurality of tongue and groove extrusions.

Referring back to FIG. 1, the overhead support system 104 is in the form of a pergola and includes a plurality of substantially horizontal support members 112 and a plurality of substantially horizontal pergola members 114. Ends of the pergola members 114 are supported by the horizontal support members 112 to provide shade or architectural effect. At least the ends of the horizontal support members 112 are supported by support pillars 106, thus spacing the horizontal support members 112 a sufficient distance above the ground or floor level to allow a person to walk under the overhead support system 104. In one embodiment, the first attachment receiving slot 212 of the face plate 200 is configured to receive and mate with the horizontal support member 112, thereby suspending the face plate 200 above the ground/floor. The second attachment receiving slot 214 is configured to receive and mate with the pergola member 114. The perpendicular attachment of the horizontal support member 112 and pergola member 114 to the face plate 200 prevents the face plate 200 from moving laterally in any direction. The support pillars 106 are substantially vertical pillars and are configured to receive at least one horizontal support member 112 and at least one pergola member 114 in a manner similar to the attachment receiving slot 214 and the pergola receiving slot 216 of the vertical posts 206.

Figure 3:
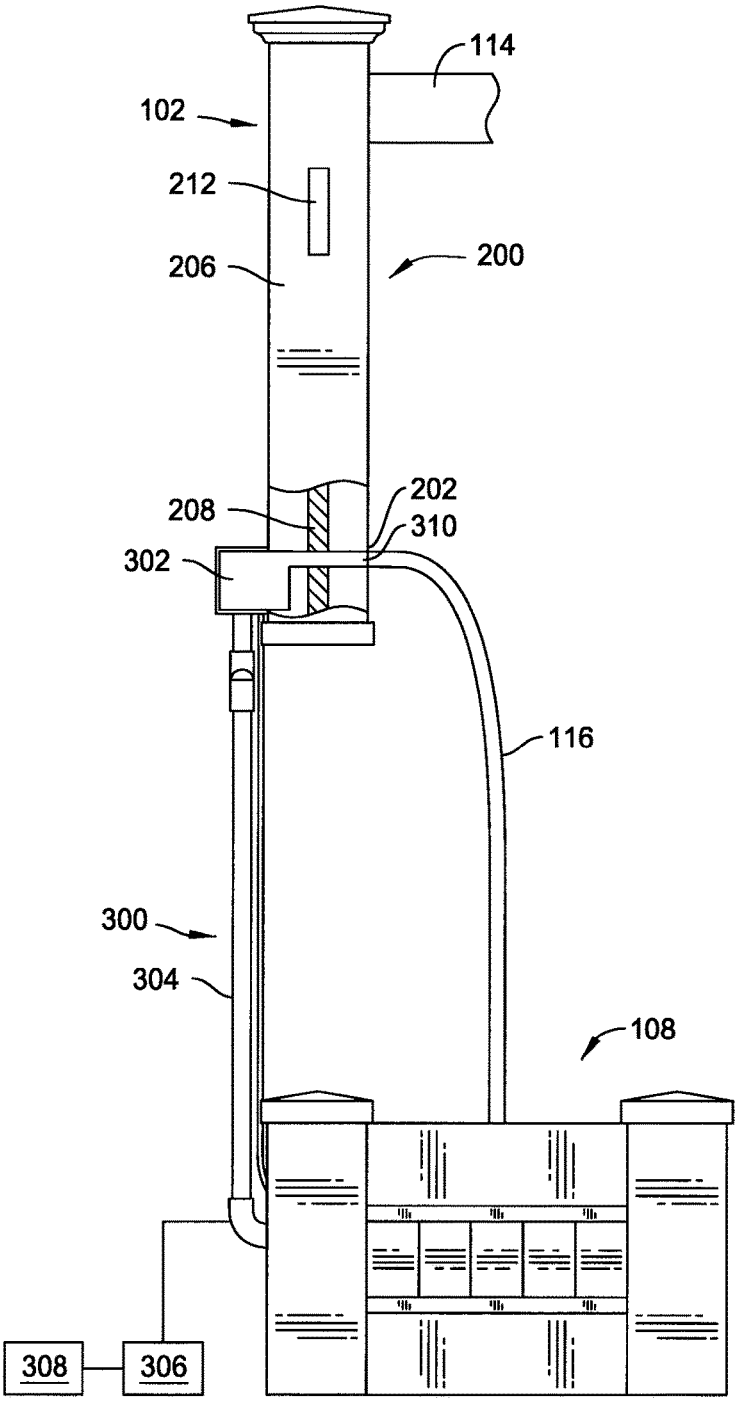
FIG. 3 is a side view of the freestanding landscape waterfall of FIG. 1.

The freestanding landscape waterfall assembly 100 also includes the catch basin 108. Referring to FIG. 3, the catch basin 108 is located beneath and substantially parallel to the freestanding landscape waterfall 200. The catch basin 108 may be filled with rocks (shown in phantom in FIG. 2) or other material to minimize splashing and to enhance the aesthetic character of the freestanding landscape waterfall assembly 100. The catch basin 108 is utilized to hold water 116 which is pumped by a pump system 300 through the freestanding landscape waterfall 102 and back into the catch basin 108.

The pump system 300 includes a pump manifold 302, a pipe 304, a pump 306 and a controller 308. The pump manifold 302 is mounted to the back side of the face plate 200 such that an outlet 310 of the pump manifold is aligned to direct water through the aperture 202. The pipe 304 connects an outlet of the catch basin 108 to pump manifold 302. The pump 306 is connected to the pipe 304 and is configured to pump water 116 from the catch basin 108 through the pipe 304 to the pump manifold 302. The pump system 300 may also include a controller 308 that is configured to control the flow of the water 116 through the pump system 300. In one embodiment, the pump 306 and the controller 308 may be external to the freestanding landscape waterfall 102 and the catch basin 108, or located internally in the freestanding landscape waterfall 102 or the catch basin 108. In another embodiment, the face plate 200 with the pump manifold 302 mounted thereto comprises a first module of the freestanding landscape waterfall assembly 100, and the catch basin 108 comprises a second module of the freestanding landscape waterfall assembly 100.

In operation, the freestanding landscape waterfall 102 is supported by the support system 104 and the support pillars 106 of the overhead support system 104, thus, suspending the waterfall 102 above the catch basin 108. The catch basin 108, located below the freestanding landscape waterfall 102, is filled with the water 116 and the pump system 300 circulates water 116 from the catch basin 108 through the pump manifold 302 and out the aperture 202 in the face plate 200 in a cascading waterfall effect back into the catch basin 108. The distance between the freestanding landscape waterfall 102 and the catch basin 108 is at least one foot or more to facilitate positioning the outlet 310 of the pump manifold 302 extending through the aperture 202 above the catch basin 108 to provide the waterfall effect. In one embodiment, the pump system 300 may also be equipped with LED lights which illuminate the water 116 in one or more colors as it flows out of the pump manifold 302 and through the aperture 202 formed in the face plate 200.

Figure 4:
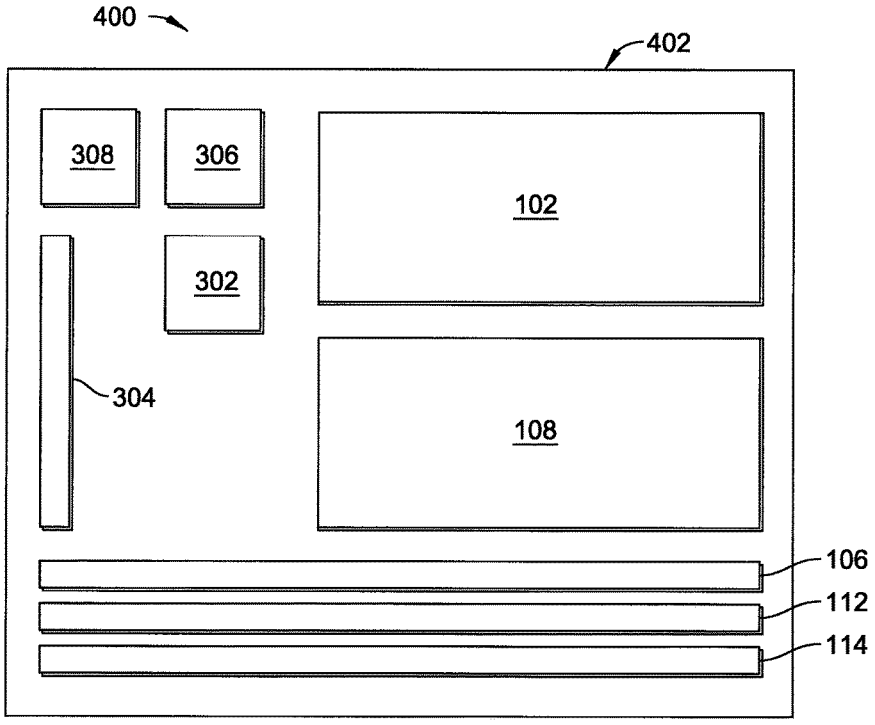
FIG. 4 is a top view of a freestanding landscape waterfall assembly kit.

Referring to FIG. 4, the freestanding landscape waterfall assembly 100 may be shipped in packaging 402. The packaging 402 may be a shipping carton, a crate, a bag, or a pallet. The freestanding landscape waterfall assembly 100 may be shipped in packaging 402 as a kit 400 for simple installation by the homeowner, or the freestanding landscape waterfall 102 may be prefabricated into modular form to enable rapid assembly with little difficulty. The kit 400 may be configured to be suspended from existing structures, and may include one or more of the freestanding landscape waterfall 102, the catch basin 108, the pump manifold 302, the pipe 304, the pump 306, and the controller 308. The kit 400 may optionally be configured to include the overhead support systems 104, including the support pillars 106, the horizontal support members 112 and the pergola members 114. The kit 400 advantageously facilities economical shipping and rapid assembly by homeowners or others having little or no masonry skills.

While the foregoing is directed to embodiments of the present invention, other and further embodiments of the invention may be devised without departing from the basic scope thereof, and the scope thereof is determined by the claims that follow.

What is claimed is:

1. A freestanding landscape waterfall assembly comprising:

a pergola configured to provide overhead shade to an area; and a freestanding landscape waterfall suspended by the pergola above the area.

2. The freestanding landscape waterfall assembly of claim 1, wherein the pergola comprises:

a plurality of support pillars;

a plurality of substantially horizontal support members supported by the support pillars the freestanding landscape waterfall suspended below the horizontal support members; and a plurality of substantially horizontal pergola members supported by the horizontal support members.

3. The freestanding landscape waterfall assembly of claim 1, wherein the free standing landscape waterfall assembly further comprises:

a catch basin positionable below the freestanding landscape waterfall.

4. The freestanding landscape waterfall assembly of claim 3, further comprising:

a pump system configured to pump water between the catch basin and the freestanding landscape waterfall.

5. The freestanding landscape waterfall assembly of claim 1, wherein the freestanding landscape waterfall comprises:

a face plate having an elongated aperture.

6. The freestanding landscape waterfall assembly of claim 5, wherein the free standing landscape waterfall further comprises:

a manifold having an outlet configured to direct water through the elongated aperture.

7. The free standing landscape waterfall assembly of claim 6, wherein the pergola further comprises:

an engagement feature configured to suspend the faceplate from the pergola.

8. The freestanding landscape waterfall assembly of claim 7, wherein the elongated aperture is disposed below the engagement feature.

9. A freestanding landscape waterfall assembly comprising:

a pergola having vertical support pillars supporting a horizontal framework configured to provide overhead shade to an area; and a freestanding landscape waterfall suspended by the pergola below the horizontal framework and above the area.

10. The freestanding landscape waterfall assembly of claim 9, wherein the horizontal framework comprises:

a plurality of substantially horizontal support members supported by the support pillars; and a plurality of substantially horizontal pergola members supported by the horizontal support members.

11. The freestanding landscape waterfall assembly of claim 9, wherein the free standing landscape waterfall assembly further comprises:

a catch basin positionable below the freestanding landscape waterfall.

12. The freestanding landscape waterfall assembly of claim 11, further comprising:

a pump system configured to pump water between the catch basin and the freestanding landscape waterfall.

13. The freestanding landscape waterfall assembly of claim 9, wherein the freestanding landscape waterfall comprises:

a face plate having an elongated aperture.

14. The freestanding landscape waterfall assembly of claim 13, wherein the free standing landscape waterfall further comprises:

a manifold having an outlet configured to direct water through the elongated aperture.

15. The free standing landscape waterfall assembly of claim 14, wherein the pergola further comprises:

an engagement feature configured to suspend the faceplate from the pergola.

16. The freestanding landscape waterfall assembly of claim 15, wherein the elongated aperture is disposed below the engagement feature.

* * * * *